US005190386A

United States Patent [19]

Eudy

[11] Patent Number: 5,190,386

[45] Date of Patent: Mar. 2, 1993

[54] PRINTER WITH EDGE STRIP TRIMMER

[76] Inventor: James R. Eudy, 4316 Whitetail La., Midland, N.C. 28107

[21] Appl. No.: 826,820

[22] Filed: Jan. 28, 1992

[51] Int. Cl.[5] ..... B41J 11/26

[52] U.S. Cl. ..... 400/621.1; 225/99

[58] Field of Search ..... 400/621.1; 225/99, 93, 225/106, 3, 100

[56] References Cited

U.S. PATENT DOCUMENTS

| | | | |
|---|---|---|---|
| 2,188,347 | 12/1940 | Fulk | 197/133 |
| 2,317,384 | 4/1943 | Johnson | 225/99 |
| 2,862,554 | 12/1958 | Davidson et al. | 225/100 |
| 4,423,975 | 1/1984 | Krenz | 400/621.1 |
| 4,616,773 | 10/1986 | Kerivan | 225/99 |
| 4,940,347 | 7/1990 | Lund | 400/621.1 |
| 4,993,856 | 2/1991 | Chung | 400/621.1 |
| 5,051,013 | 9/1992 | Song | 400/498 |

FOREIGN PATENT DOCUMENTS

| | | | |
|---|---|---|---|
| 3119998 | 5/1981 | Fed. Rep. of Germany | 400/621.1 |
| 2599298 | 5/1986 | France . | |

*Primary Examiner*—Edgar S. Burr
*Assistant Examiner*—Anthony H. Nguyen
*Attorney, Agent, or Firm*—W. Thad Adams, III

[57] ABSTRACT

A printer having first and second opposed sprockets positioned on opposed sides of a printer platen for feeding from an upstream to a downstream direction continuous-feed paper sheets having continuous-feed edge strips formed along the opposing sides of the paper sheets. A edge strip trimming apparatus is provided in combination with the printer. The edge strip trimming apparatus includes first and second edge strip trimmers. Each of the edge strip trimmers have edge strip hold-down devices positioned in closely spaced-apart relation to one of the first and second sprockets for holding the edge strip against the sprocket as the paper is fed through the printer. An inclined paper support bed extends inwardly from the edge strip hold down device to a point underneath the horizontal plane of the paper sheet for progressively diverging the plane of the edge strip from the plane of the paper sheet as the paper sheets are successively fed through the printer. The support bed defines an edge surface. The edge surface has a gradual compound curve which tapers outwardly towards the edge strip hold down device and forwardly in the direction from which the paper sheets are fed through the printer to separate the edge strip from the paper sheet by moving the paper sheet simultaneously away from the edge strip in a vertical and lateral plane thereby causing progressive simultaneous separation in two planes.

14 Claims, 6 Drawing Sheets

PRINTER WITH EDGE STRIP TRIMMER

TECHNICAL FIELD AND BACKGROUND OF THE INVENTION

This invention relates to a printer which feeds continuous feed paper sheets thought the printer by means of edge strips which are formed on opposite sides of the paper sheets. Such printers range from very expensive, high speed line printers to very inexpensive printers sold primarily for small business and home use. Such printers use paper which is in a continuous length, but with spaced-apart, laterally-extending perforation lines. The paper can be separated into individual sheets when desired by tearing along the perforation line. The paper sheets may be successive pages of documents such as reports or letters, support or carrier sheets for envelopes, adhesive labels or stickers, or successive sheets of invoices, checks, receipts or other documents.

The edge strips are also separable from the paper sheets by means of perforation lines which extend along the length of the paper sheets. The perforation lines define the edge strip and paper sheets on opposite sides thereof. The edge strips have holes which extend along its length at regularly spaced-apart intervals which match the spacing of sprocket teeth on the axially-extending peripheral surface of sprocket wheels which are positioned on opposite sides of the printer at the paper platen.

The edge strips are usually manually torn from the paper sheets after the paper has been removed from the printer. This is a tedious, time consuming job. For this reason, those trimming the edge strips manually tend to try to remove the edge strips from a number of sheets at the same time by fan folding the sheets, if they are not already fan folded. If too many layers are stripped at the same time, the edge strip can fail to separate cleanly, and can either leave a ragged remnant of the edge strip attached to the paper sheet, or can tear into the paper sheet, thereby requiring that sheet to be re-printed.

The invention of this application relates to a edge strip trimmer, and a printer which incorporates a pair of edge strip trimmers positioned on opposite sides of the printer to separate the edge strip from the paper sheet to which it is attached as the paper sheets are fed through the printer.

SUMMARY OF THE INVENTION

Therefore, it is an object of the invention to provide a printer which includes a pair of edge strip trimmers for trimming the edge strip from a paper sheet.

It is another object of the invention to provide a edge strip trimmer which can be attached to a conventional printer in order that the edge strips attached to continuous-feed paper sheets can be removed automatically as the paper sheets are printed and fed from the printing zone of the printer.

These and other objects of the present invention are achieved in the preferred embodiments disclosed below by providing a printer having first and second opposed sprocket means positioned on opposed sides of a printer platen for feeding from an upstream to a downstream direction continuous-feed paper sheets having continuous-feed edge strips formed along the opposing sides of the paper sheets. A edge strip trimming apparatus is provided in combination with the printer. The edge strip trimming apparatus comprises first and second edge strip trimmers. Each of the edge strip trimmers comprise edge strip hold-down means positioned in closely spaced-apart relation to one of the first and second sprocket means for holding the edge strip against the sprocket means as the paper is fed through the printer. Separating means are provided for separating the edge strip from the paper sheet. The separating means comprise an inclined paper support bed for extending inwardly from the edge strip hold down means to a point underneath the horizontal plane of the paper sheet for progressively diverging the plane of the edge strip from the plane of the paper sheet as the paper sheets are successively fed through the printer. The support bed defines an edge surface, the edge surface having a gradual compound curve which tapers outwardly towards the edge strip hold down means and forwardly in the direction from which the paper sheets are fed through the printer to separate the edge strip from the paper sheet by moving the paper sheet simultaneously away from the edge strip in a vertical and lateral plane thereby causing progressive simultaneous separation in two planes.

According to one preferred embodiment of the invention, the sprocket means comprise sprocket wheels having sprocket teeth spaced around the axially extending periphery of the sprocket wheel, and the edge strip hold down means is annular for being positioned in closely conforming relation to the curved surface of the sprocket wheel.

According to another preferred embodiment of the invention, each of the edge strip trimmers are positioned on pivots for being pivoted into and out of cooperation with the sprocket means.

According to another preferred embodiment of the invention, each of the edge strip trimmers are integrally formed from a hard plastic material.

According to yet another preferred embodiment of the invention, each of the edge strip trimmers are integrally formed from a hard plastic material and are integrally-formed with the pivot means.

According to yet another preferred embodiment of the invention, the support bed defines upper and lower surfaces which diverge in the direction of travel of the paper sheets through the printer and define the edge surface of the paper sheet support bed.

According to yet another preferred embodiment of the invention, the edge strip trimmer includes paper sheet hold down means attached to the edge strip hold down means and extending inwardly into the vertical plane of the paper sheet and above the horizontal plane of the paper sheet in upstream orientation to the edge surface for holding the paper sheet close to the platen until separation from the edge strip begins.

In accordance with the sub-combination according to the invention, a edge strip trimmer is provided for being attached to one side of a printer has sprocket means which feeds from an upstream to a downstream direction continuous-feed paper sheets having continuous-feed edge strips formed along the opposing sides of the paper. The edge strip trimmer comprises edge strip hold-down means positioned in closely spaced-apart relation to the sprocket means for holding the edge strip against the sprocket means as the paper is fed through the printer. Separating means are provided for separating the edge strip from the paper sheet. The separating means comprise an inclined paper support bed for extending inwardly from the edge strip hold down means to a point underneath the horizontal plane of the paper sheet for progressively diverging the plane of the edge strip from the plane of the paper sheet as the paper sheets are successively fed through the printer. The support bed defines an edge surface, the edge surface having a gradual compound curve which tapers outwardly towards the edge strip hold down means and forwardly in the direction from which the paper sheets are fed through the printer to separate the edge strip from the paper sheet by moving the paper sheet simultaneously away from the edge strip in a vertical and lateral plane thereby causing progressive simultaneous separation in two planes.

BRIEF DESCRIPTION OF THE DRAWINGS

Some of the objects of the invention have been set forth above. Other objects and advantages of the invention will appear as the invention proceeds when taken in conjunction with the following drawings, in which.

DESCRIPTION OF THE PREFERRED EMBODIMENT AND BEST MODE

Figure 1:
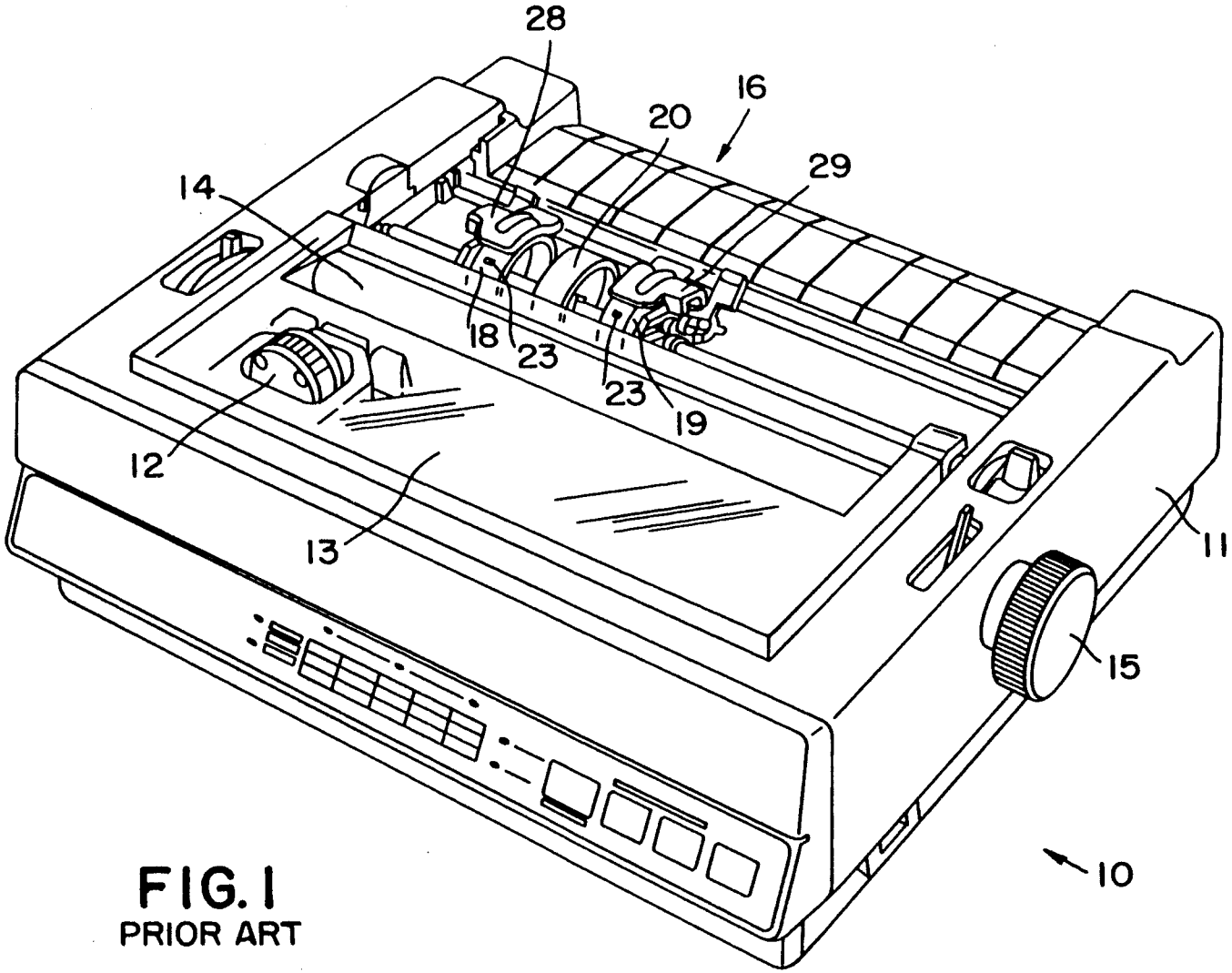
FIG. 1 PRIOR ART
FIG. 1 is a overall perspective view of a printer including tractor feed means according to the prior art.

Referring now specifically to the drawings, a printer according to the prior art is illustrated in FIG. 1 and shown generally at reference numeral 10. The printer 10 includes a printer housing 11, a print head 12, a transparent cover 13, and a platen 14 to which a platen knob 15 is attached for manual feeding of the paper through the printer 10.

Continuous feed paper sheets are pulled through the printer 10 by a tractor feed apparatus 16. The tractor feed apparatus 16 includes a pair of tractor feed sprocket wheels 18 and 19 which are spaced-apart the proper distance to accommodate paper sheets of a given width. A support wheel 20 is positioned between the sprocket wheels 18 and 19 and supports the paper sheets at a point intermediate the sprocket wheels 18 and 19. As shown in FIG. 1 sprockets 18 and 19 are moved together clarity, but would be in this position for feeding narrow labels and the like. Ordinarily, the sprocket wheels 18 and 19 would be positioned opposite sides of the printer 10 to accommodate full width paper sheets.

Sprocket wheels 18 and 19 have sprocket teeth 23 molded into their respective axially-extending peripheral surfaces.

Figure 9:
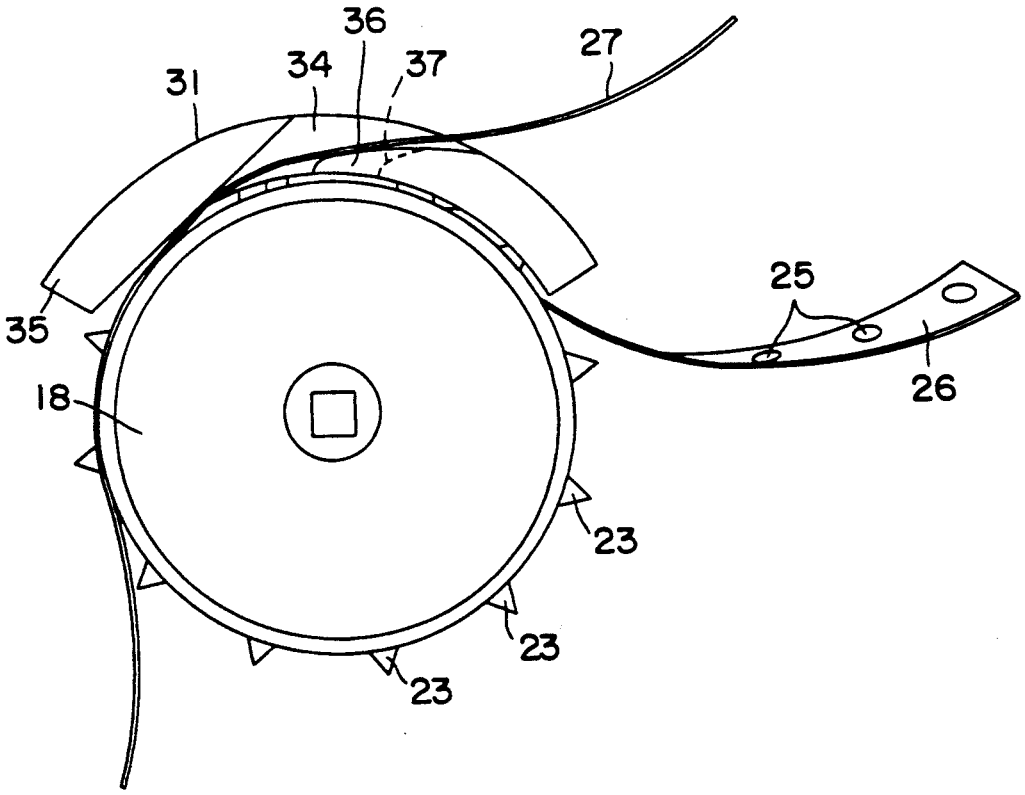
FIG. 9 is a side elevation showing the feed paths of the edge strip and paper sheet though the edge strip trimmer.

As is best shown in FIG. 9, these sprocket teeth 23 are spaced to match the spacing of holes 25 in a edge strip 26 defined on opposite lateral sides of a paper sheet 27 by perforation lines. The edge strips 26 are held onto the sprocket wheels 18 and 19 by a pair of covers 28 and 29 which are pivoted and flip into place over respective sprocket wheels 18 and 19. The covers 28 and 29 define a narrow space between the covers 28 and 29 and respective sprocket wheels 18 and 19 which hold the edge strips 26 onto the sprocket teeth 23 but allow enough space to permit unrestricted movement of the edge strips 26 between them.

Figure 2:
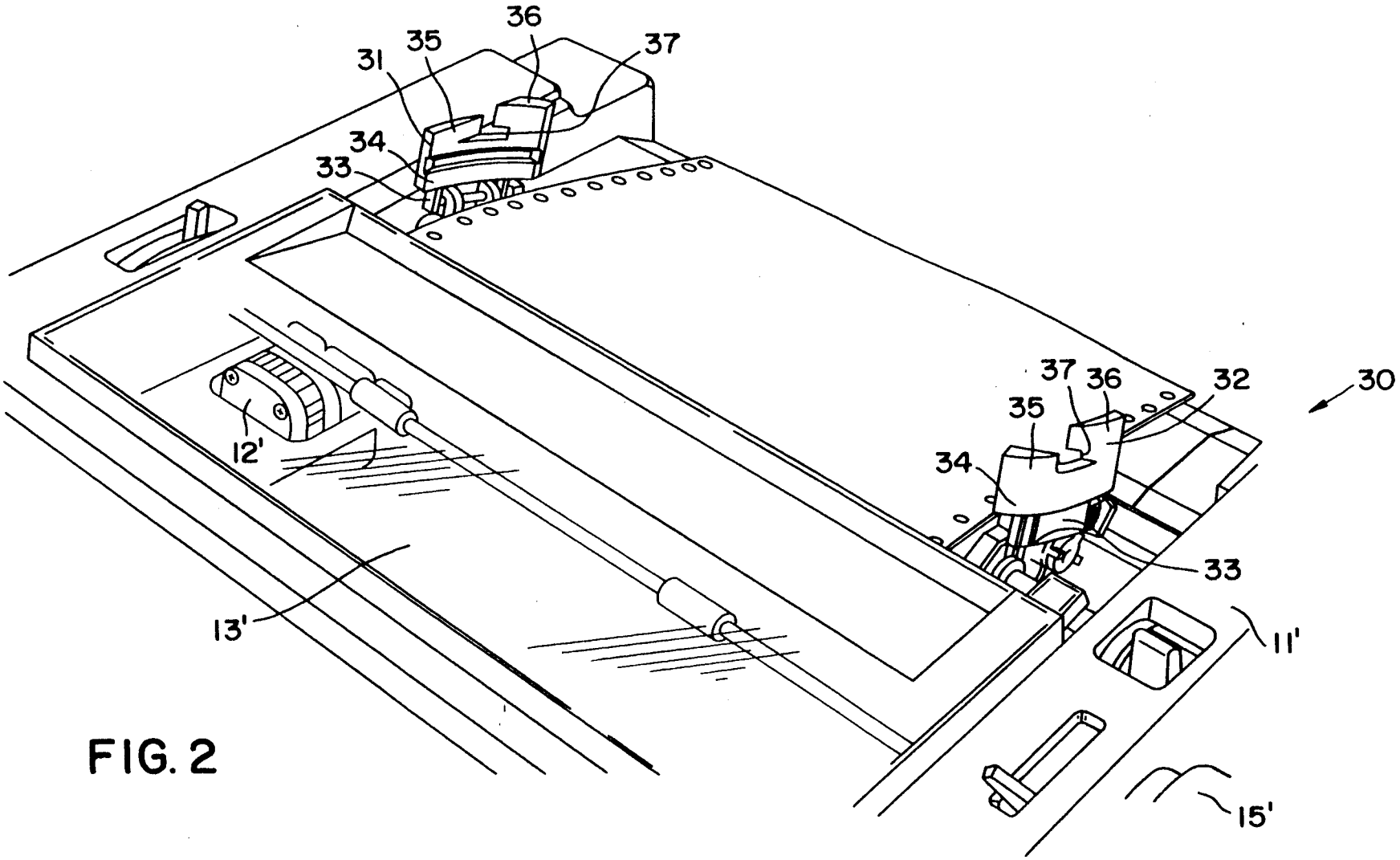
FIG. 2 is a fragmentary perspective view of a printer including a pair of edge strip trimmers in their inoperative position.

Referring now to FIG. 2, a printer 30 according to the invention is illustrated. Parts identical to the parts identified with reference to FIG. 1 are indicated by prime reference numerals. Two edge strip trimmers 31 and 32 are shown positioned above the sprocket wheels 18 and 19, respectively. Edge strip trimmers 31 and 32 are identical mirror images of each other. Each of the edge strip trimmers may be fabricated of a hard plastic such as polystyrene, may be investment cast of aluminum, or may be made of other suitable materials by suitable molding or machining processes familiar to those with skill in the art.

The description will proceed with reference to edge strip trimmer 31, it being understood that the same elements and functions apply equally to edge strip trimmer 32.

Figure 3:
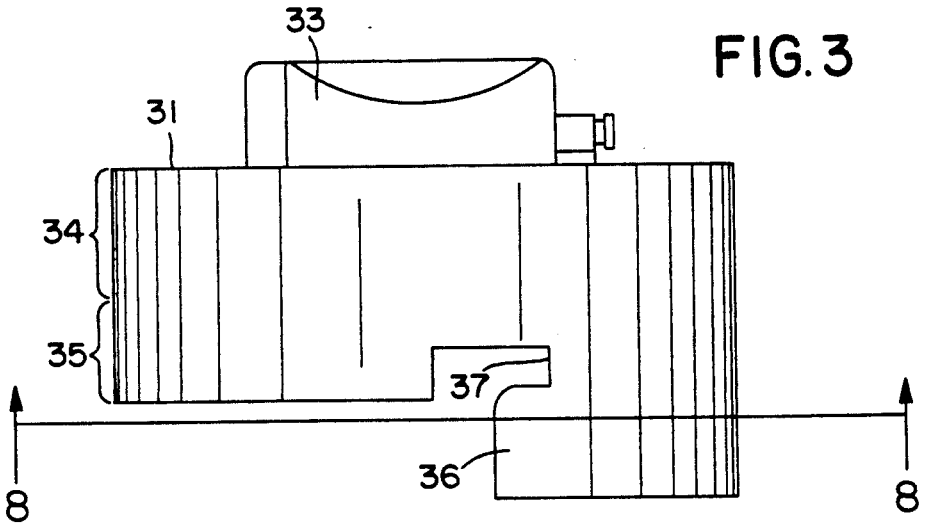
FIG. 3 is a top plan view of a edge strip trimmer according to one embodiment of the invention.
Figure 4:
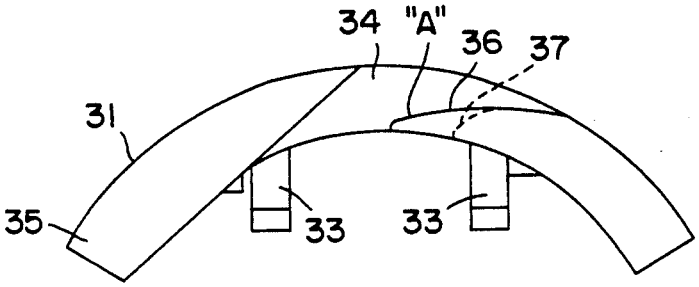
FIG. 4 is a side elevation of the edge strip trimmer according to an embodiment of the invention shown in FIG. 3.
Figure 5:
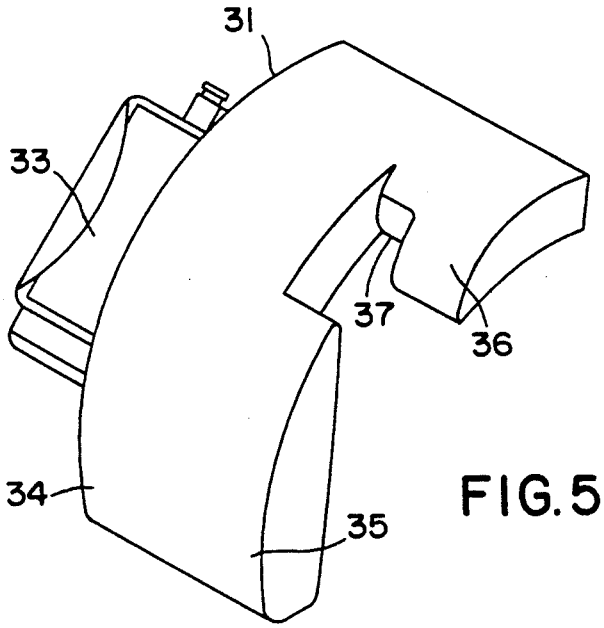
FIG. 5 is a perspective view the edge strip trimmer according to the embodiment of the invention shown in FIGS. 3 and 4.
Figure 6:
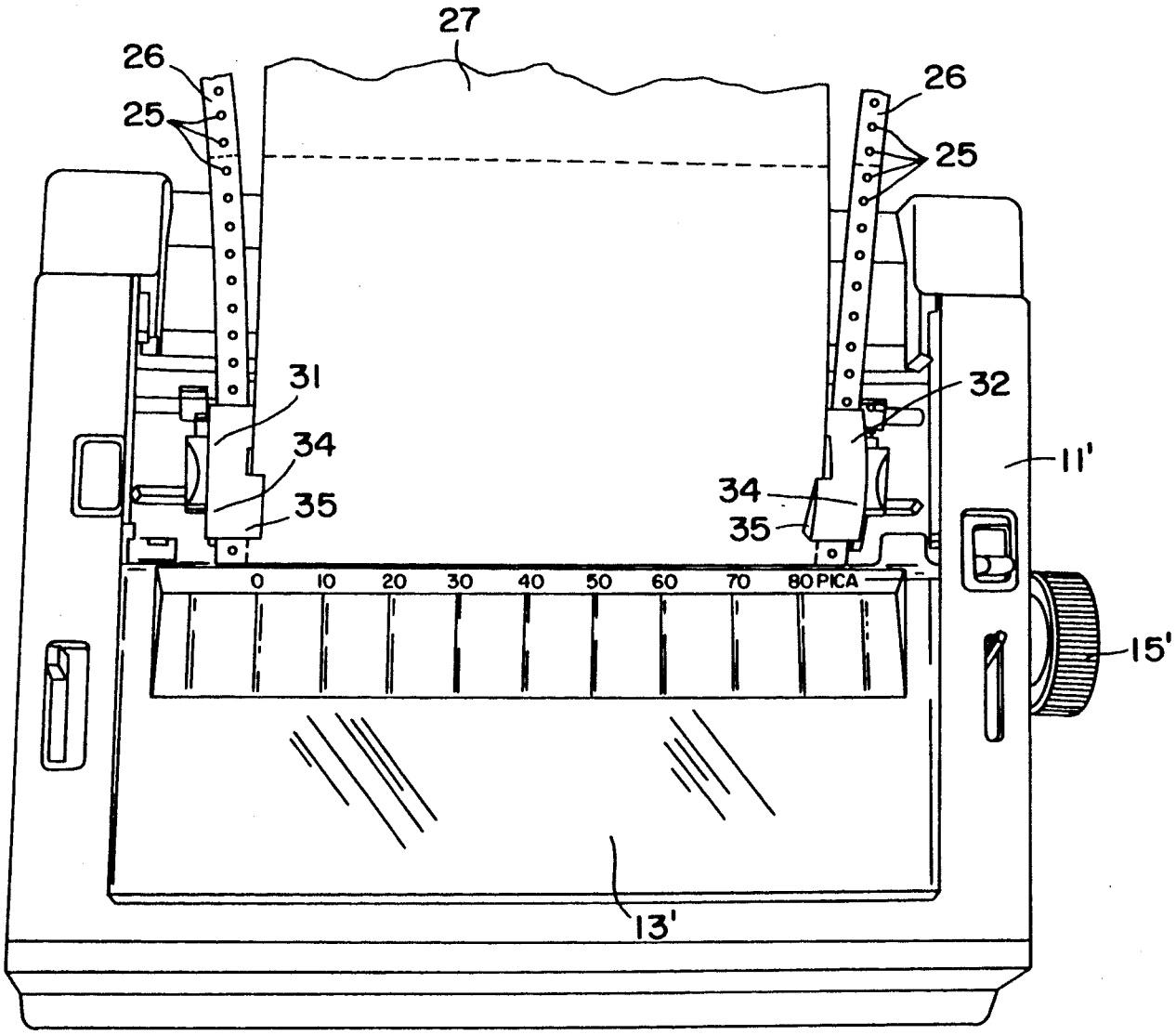
FIG. 6 is a perspective view of a printer including a pair of edge strip trimmers in their operative position, showing the edge strips as they are removed.

Edge strip trimmer 31 is positioned by a hinged mounting 33 onto the printer 30 above the sprocket wheel 18. As is shown in FIG. 2, the edge strip trimmer 31 is pivotable between an inoperative position, as shown in FIG. 2, and a closed, operative position shown in FIGS. 6 and 7. Referring now to FIGS. 3, 4 and 5, edge strip trimmer 31 may be molded or machined of a durable material such as polystyrene or other materials, as described above, and includes three principle functional zones. A edge strip hold-down means positioned 34 extends along the length of the edge strip trimmer 31 and is positioned in closely spaced-apart relation sprocket wheel 18 and holds the edge strip 26 against the sprocket wheel 26 as the paper is fed through the printer 30.

A paper sheet hold-down means 35 extends approximately halfway the length of the edge strip trimmer 31, and holds the paper sheet in the same plane as the edge strip 26 as it passes under the sprocket wheel 18.

Separating means for are provided for separating the edge strip 26 from the paper sheet 27. The separating means comprise an inclined paper support bed 36 which extends inwardly from the edge strip hold down means 34 to a point underneath the horizontal plane of the paper sheet 27. The support bed 36 is ramped and progressively diverges the plane of the edge strip 26 from the plane of the paper sheet 27 as the paper sheets 27 are successively fed through the printer 30. The support bed 36 defines an edge surface adjacent the free end of the support bed 36. The edge surface has a gradual compound curve which tapers outwardly towards the edge strip hold down means 34 and forwardly in the direction from which the paper sheets 27 are fed through the printer 30 to separate the edge strip 26 from the paper sheet 27. The occurs by moving the paper sheet 27 simultaneously away from the edge strip 26 in a vertical and lateral plane. The causes a progressive simultaneous separation of the edge strip from the paper sheet 27 in two planes.

Figure 8:
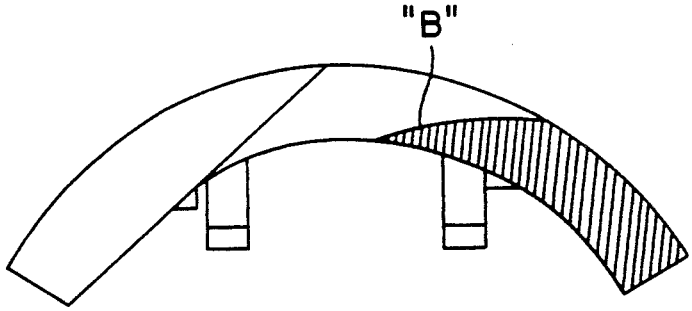
FIG. 8 is a partial cross section of the edge strip trimmer taken substantially along the lines 8—8 of FIG. 3.

The configuration of the compound curve on the support bed 36 is best shown in FIGS. 4, 5 and 8. By comparing the thickness and position of the support bed 36 at point "A" of FIG. 4 and at point "B" of FIG. 8, is can be seen that the support bed 36 at point "B" is thinner than at point "A" as a result of the tapering compound curve. The support bed 36 must be smoothly formed and have even, rounded edges in order to function optimally. A sharp edge will offer too much resistance and fail to allow the edge strips 26 to slip off of the sprocket wheel 18 as they exit the printer 30. This can cause locking or jamming of the paper transport system. The slope of the support bed 36 is very gradual so that the resistance of the paper sheet 27 as is slides up the support bed 36 is only very little more than the resistance on the paper sheet 27 during normal feeding through the printer 30.

A notch 37 is formed between the support bed 36 and the center portion of the edge strip hold-down means 34. This notch 37 is in the vertical plane of the perforation between the edge strip 26 and the paper sheet 27. The notch 37 prevents the paper from contacting the support bed at the edge of the notch 37. Contact would tend to offer resistance to the flow of the paper and prevent the desired separation between the paper sheet 27 and the edge strip 26. This might lead to locking of jamming of the paper transport system if the edge strip 26 did not properly slip off of the sprocket wheel 18.

The path of the edge strip 26 and the paper sheet 27 through the edge strip trimmer 31 is illustrated in FIG. 9. Note that the separation of the paper sheet 27 from the edge strip 26 begins upstream of the edge of the support bed 36 so that the angle of separation is very gradual, and extends through the area behind support bed 36, and rides over the support bed 36 to the trailing edge of the support bed 36.

The edge strip 2 continues under the edge strip hold-down means 34 and exits the edge strip trimmer at the end opposite from where it entered.

Figure 7:
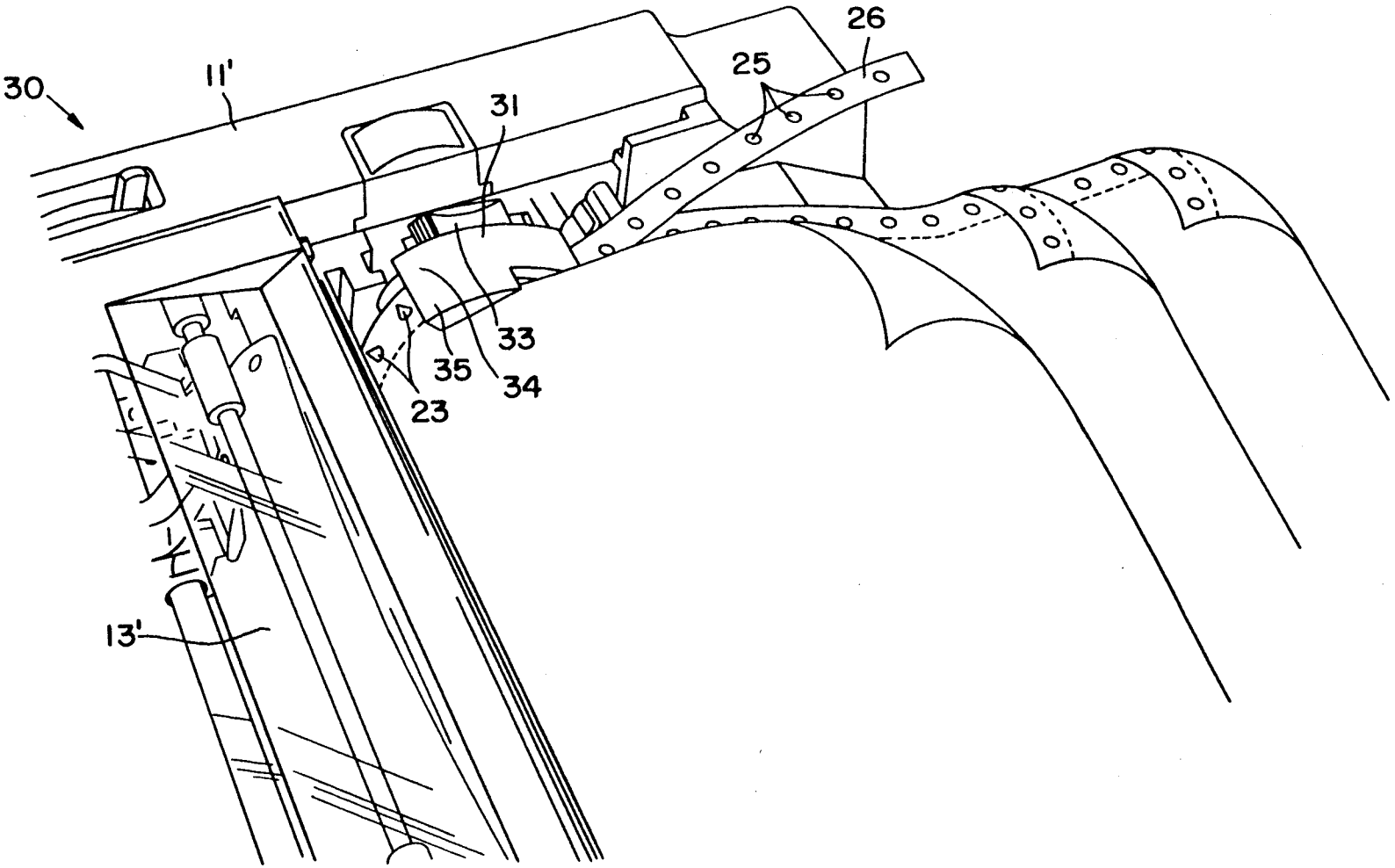
FIG. 7 is a enlarged fragmentary perspective view of the edge strip trimmers and feed sprockets with the edge strip trimmers in place over them, showing how less than all of several edge strip trimmers can be removed.

Referring now to FIG. 7, the design of the edge strip trimmer 31 permits selective separation of the edge strip 26 from one or more but less than all of a plurality of paper sheets 27. This is accomplished by positioning the paper sheets 27 which are not to be separated from the edge strip 26 under the support bed 36 so that the paper sheets 27 remain in the same horizontal plane as the edge strips 26 attached to the respective paper sheet 27. The paper sheet 27 to be separated from its edge strip 26 is positioned to feed over the support bed, as described above. As is shown in FIG. 7, the two bottom paper sheets 27 and the still-attached edge strip 26 feed through the edge strip trimmer 31 without separating, while the top paper sheet 27 separates from the edge strip 26.

When, for whatever reason, none of the edge strips 26 are to be removed from the paper sheets 27, then all of the paper sheets 27 are fed under the support bed 36 and the paper feeds through the edge strip trimmer 31, and none of the edge strips 26 are removed. Of course, this is true if only one sheet is being fed through the printer 30.

The invention has been described with reference to a printer of the type which has sprocket wheels as the basis of the paper transport system. Other printers use a sprocket belt which rotates around two spaced-apart sprocket pulleys. The sprocket belt therefore defines an upper and a lower planar belt surface. As the belt rotates, sprocket teeth on the outer surface of the belt mate with the sprocket holes in the edge strips 26 as described above. The invention is equally applicable to use on a printer having a sprocket belt instead of a sprocket wheel. The shape of the edge strip trimmer would be modified so that the underside would be more planar to more closely correspond to the planar shape of the upper surface of the sprocket belt.

An edge strip trimmer and a printer having edge strip trimmers is described above. Various details of the invention may be changed without departing from its scope. Furthermore, the foregoing description of the preferred embodiment of the invention and the best mode for practicing the invention are provided for the purpose of illustration only and not for the purpose of limitation—the invention being defined by the claims.

I claim:

1. In a printer having first and second opposed sprocket means positioned on opposed sides of a printer platen for feeding from an upstream to a downstream direction continuous-feed paper sheets having continuous-feed edge strips formed along the opposing sides of the paper sheets, the combination of a edge strip trimming apparatus, said edge strip trimming apparatus comprising first and second edge strip trimmers, each of said edge strip trimmers including means for separating said edge strip from said paper sheets before the edge strip leaves the sprocket means, said means for separating including:

(a) edge strip hold-down means positioned in spaced-apart relation to one of the first and second sprocket means for receiving a sheet of paper to be separated from the edge strip and for holding the edge strip against the sprocket means as the paper is fed through the printer;

(b) separating means for separating the edge strip from the paper sheet, said separating means comprising an inclined paper support bed extending inwardly from the edge strip hold down means to a point underneath the horizontal plane of the paper sheet for progressively divergent the plane of the edge strip from the plane of the paper sheet as the paper sheets are successively fed through the printer;

(c) said support bed defining an edge surface, said edge surface having a gradual compound curve which tapers both outwardly towards the edge strip hold down means and forwardly in the direction from which the paper sheets are fed through the printer to separate the edge strip from the paper sheet by moving the paper sheet simultaneously away from the edge strip in both a vertical and a lateral plane thereby causing progressive simultaneous separation in two planes.

2. In a printer according to claim 1, wherein said sprocket means comprise sprocket wheels having sprocket teeth spaced around the axially extending periphery of the sprocket wheel, and wherein said edge strip hold down means is annular for being positioned in closely conforming relation to the curved surface of the sprocket wheel.

3. In a printer according to claim 1, wherein said edge strip trimmers are positioned on pivots for being pivoted into and out of cooperation with said sprocket means.

4. In a printer according to claim 3, wherein edge strip trimmers are integrally formed from a hard plastic material.

5. In a printer according to claim 3, wherein said edge strip trimmers are integrally formed from a hard plastic material and are integrally-formed with said pivot means.

6. In a printer according to claim 1, wherein said support bed defines upper and lower surfaces which diverge in the direction of travel of the paper sheets through the printer and define said edge surface of the paper sheet support bed.

7. In a printer according to claim 1, and including paper sheet hold down means attached to said edge strip hold down means and extending inwardly into the vertical plane of the paper sheet and above the horizontal plane of the paper sheet in upstream orientation to the edge surface for holding the paper sheet close to the platen until separation from the edge strip begins.

8. A edge strip trimmer for being attached to one side of a printer having sprocket means which feeds from an upstream to a downstream direction continuous-feed paper sheets having continuous-feed edge strips formed along the opposing sides of the paper; said edge strip trimmer including means for separating said edge strip from said paper sheets before the edge strip leaves the sprocket means, said means for separating including:

(a) edge strip hold-down means positioned in spaced-apart relation to the sprocket means for receiving a sheet of paper to be separated from the edge strip and for holding the edge strip against the sprocket means as the paper is fed through the printer;

(b) separating means for separating the edge strip from the paper sheet, said separating means comprising an inclined paper support bed extending inwardly from the edge strip hold down means to a point underneath the horizontal plane of the paper sheet for progressively divergent the plane of the edge strip from the plane of the paper sheet as the paper sheets are successively fed through the printer;

(c) said support bed defining an edge surface, said edge surface having a gradual compound curve which tapers both outwardly towards the edge strip hold down means and forwardly in the direction from which the paper sheets are fed through the printer to separate the edge strip from the paper sheet by moving the paper sheet simultaneously away from the edge strip in both a vertical and a lateral plane thereby causing progressive simultaneous separation in two planes.

9. A edge strip trimmer according to claim 1, wherein said edge strip hold down means is annular for being positioned in closely conforming relation to the curved surface of a sprocket wheel, said sprocket wheel having sprocket teeth specked around a axially extending periphery thereof.

10. A edge strip trimmer according to claim 8, wherein said edge strip trimmer is positioned on a pivot for being pivoted into and out of cooperation with said sprocket means.

11. A edge strip trimmer according to claim 10, wherein said edge strip trimmer is integrally formed from a hard plastic material.

12. A edge strip trimmer according to claim 10, wherein said edge strip trimmer is integrally formed from a hard plastic material and is integrally-formed with said pivot means.

13. A edge strip trimmer according to claim 8, wherein said support bed defines upper and lower surfaces which diverge in the direction of travel of the paper sheets through the printer and define said edge surface of the paper sheet support bed.

14. A edge strip trimmer according to claim 8, and including paper sheet hold down means attached to said edge strip hold down means and extending inwardly into the vertical plane of the paper sheet and above the horizontal plane of the paper sheet in upstream orientation to the edge surface for holding the paper sheet close to the platen until separation from the edge strip begins.

* * * * *